United States Patent [19]

Funada

[11] Patent Number: 4,809,041

[45] Date of Patent: Feb. 28, 1989

[54] IMAGE FORMING APPARATUS WITH STORAGE OF PROCESSING MODES

[75] Inventor: Masahiro Funada, Yokohama, Japan

[73] Assignee: Canon Kabushiki Kaisha, Tokyo, Japan

[21] Appl. No.: 11,754

[22] Filed: Feb. 6, 1987

[30] Foreign Application Priority Data

| | | | |
|---|---|---|---|
| Feb. 12, 1986 | [JP] | Japan | 61-26942 |
| Feb. 12, 1986 | [JP] | Japan | 61-26943 |
| Feb. 12, 1986 | [JP] | Japan | 61-26944 |
| Feb. 12, 1986 | [JP] | Japan | 61-26945 |

[51] Int. Cl.[4] ..... G03G 15/00

[52] U.S. Cl. ..... 355/14 C; 355/14 R

[58] Field of Search ..... 355/14 C, 14 R, 3 R

[56] References Cited

U.S. PATENT DOCUMENTS 4,494,861 1/1985 Tachika et al. ..... 355/14 C X

*Primary Examiner*—A. C. Prescott

*Assistant Examiner*—Jane Lau

*Attorney, Agent, or Firm*—Fitzpatrick, Cella, Harper & Scinto

[57] ABSTRACT

An image processing apparatus includes: a section for setting an image processing mode; a memory for storing a processing mode necessary for processing an image and set by the operating section as an operating mode, the memory being capable of storing a plurality of such modes; an input section for inputting a command for reading the modes stored in the memory; a controller responsive to the command from the input section for reading a plurality of operating modes stored in the memory in a predetermined order; and a process for performing an image processing based on a mode read by the controller.

24 Claims, 8 Drawing Sheets

IMAGE FORMING APPARATUS WITH STORAGE OF PROCESSING MODES

BACKGROUND OF THE INVENTION

1. Field of the Invention

The present invention relates to an image forming apparatus.

2. Related Background Art

In a known image forming apparatus, an image is read at an image reading section (reader) in an operating mode set through an operating section, processed for image editing, image storage, image transmission and the like, and outputted as a reproduced image from an image output section (printer).

With such an image forming system, an operator handles various operating mode setting switches disposed on the operating section to set a desired operating mode while viewing displays. For instance, to obtain five copies of an image on A4 size recording paper at an image forming magnification of 124% and at a standard image density, the operator selects proper operating mode setting switches on the operating section to correctly set a desired operating mode while confirming it on the displays.

The number of setting switches on the operating section and the number of displays increase as the image forming functions increase in number. As a result, an inexperienced operator often handles the switches erroneously. Or frequently, the same operating mode must be set a second time due to interruption while forming an image. Thus, the operator must go to the trouble of setting an operating mode each time an image is to be formed, thus extraordinarily degrading the image forming efficiency.

SUMMARY OF THE INVENTION

An object of the present invention is to eliminate the above-described disadvantages.

Another object of the present invention is to provide an image forming apparatus capable of setting and storing an operating mode with simple operations and preventing the same operating mode from being stored.

A further object of the present invention is to provide an image forming apparatus capable of setting and storing an operating mode with simple operations.

A still further object of the present invention is to provide an image forming apparatus capable of automatically storing an operating mode with simple operations.

Another object of the present invention is to provide an image forming apparatus capable of storing an operating mode and reading it at any time with simple operations.

The other objects, features and advantages of the present invention will become apparent from the following description, taken in conjunction with the accompanying drawings.

DETAILED DESCRIPTION OF THE PREFERRED EMBODIMENTS

Figure 1:
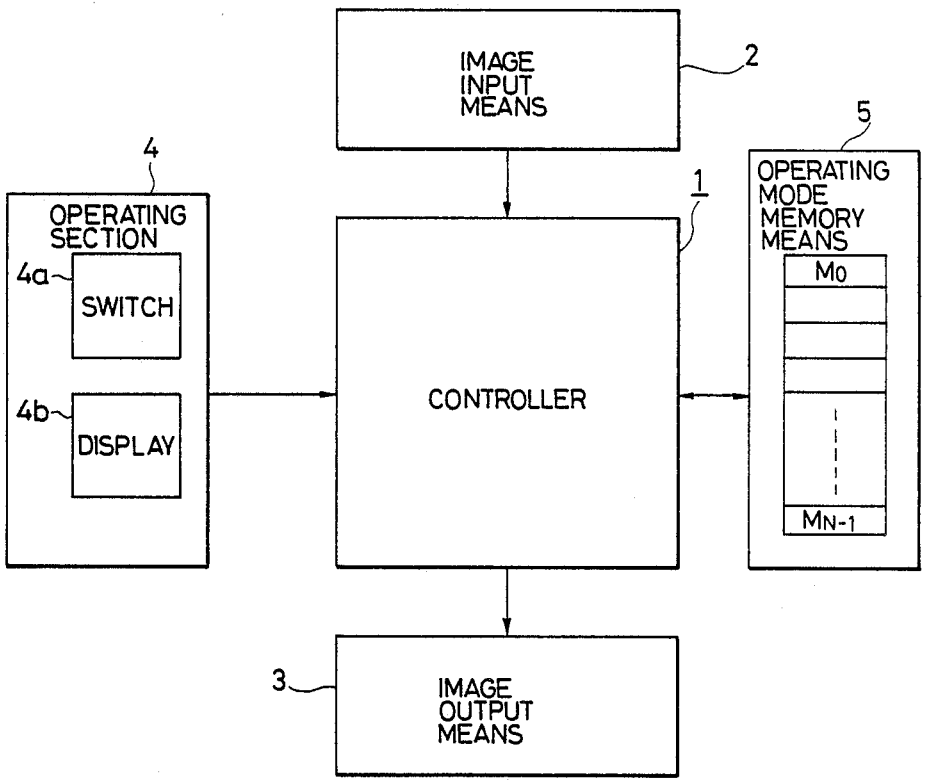
FIG. 1 is a block diagram for explaining the construction of an embodiment of the image forming appartus according to the present invention.

FIG. 1 is a block diagram showing the construction of an embodiment of the image forming apparatus according to the present invention. In the Figure, a controller 1 is constructed, for example, of a microcomputer including a ROM storing programs for image processing, and a RAM. The controller 1 also functions as the operating mode setting means and write control means referred to below. An image input means 2 is constructed, for example, of an optical scanner for reading an image with an image pickup element such as a CCD and outputting electric signals. An image output means 3 is constructed, for example, of a laser beam printer for forming an image based on the electric signals. An operating section 4 is constructed of switches 4*a* for setting a function necessary for image processing, and 4*b*. An operating mode memory means 5 is constructed, for example, of a battery back-up RAM, and sequentially stores, as an operating mode, an image processing function necessary for forming an image and set by the operating section 4. A number of switches 4*a* for setting an image processing function necessary for forming an image, and displays 4*b*, are disposed on the operating section 4.

Next, the operation of the apparatus shown in FIG. 1 will be described.

After the power is turned on and the controller 1 initializes the necessary circuits, if the operating section 4 instructs the machine to store a currently set image processing function as an operating mode, the controller 1 causes the currently set operating mode to be written in the operating mode memory means 5 and makes such effect to be displayed on a display 4*b* of the operating section 4. By repeating such operations, a plurality of operating modes representative of necessary image processing functions can be sequentially written in the operating mode memory means 5. If the same operating mode as that already stored in the operating mode memory means 5 has been set, the controller 1 inhibits it from being written in the operating mode memory means 5.

To read a written operating mode, a read command is inputted to the controller 1 by actuation of the switch 4*a* of the operating section 4. Then, the controller 1 accesses the operating mode memory means 5 to cyclically read operating modes starting from the newest one to find the desired operating mode and set it. When the operating section 4 raises an image forming command, the controller controls the image output means in accordance with the set operating mode. The read-out image information is sent to the image output means 3 to reproduce the image.

Figure 2:
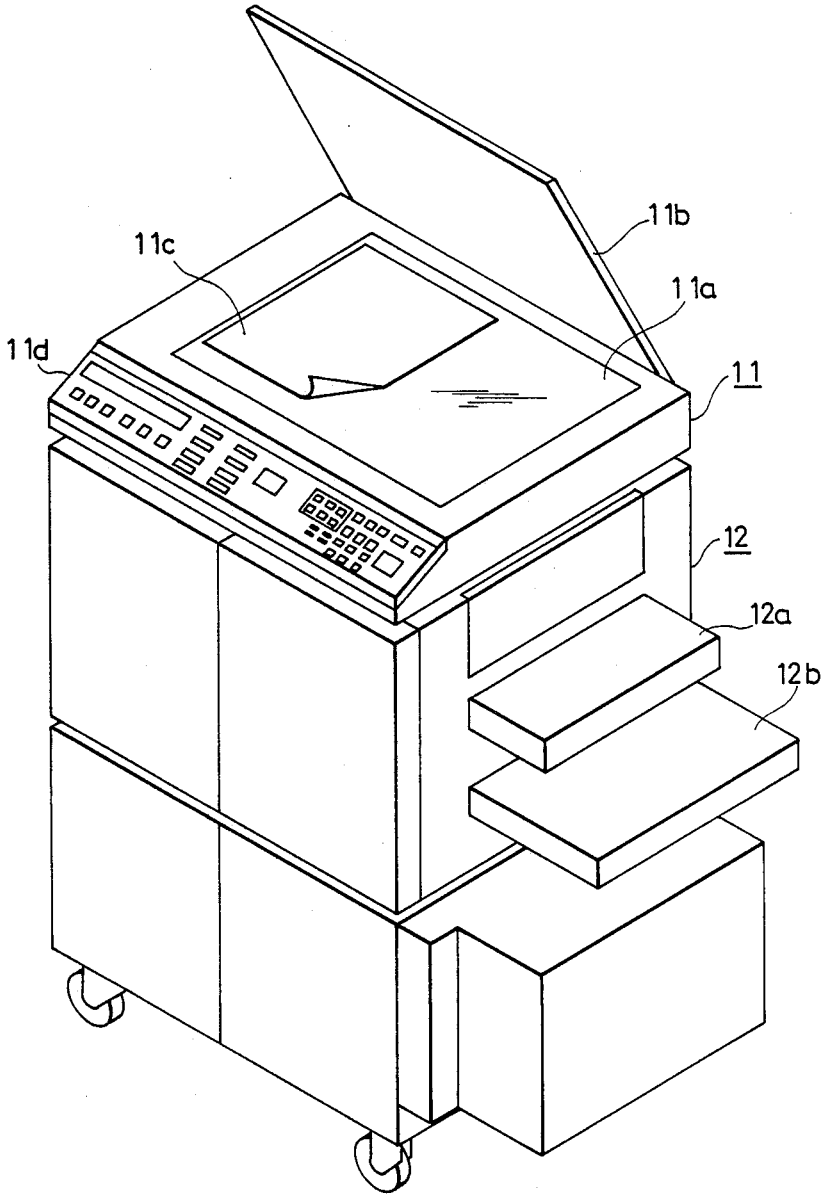
FIG. 2 is a perspective view of an exemplified embodiment of the image forming apparatus according to the present invention.

FIG. 2 is a perspective view of an embodiment of the image forming apparatus according to the present invention. An image input section 11 optically reads the image of an original 11c set on an original support 11a with an original press plate 11b pressed thereupon. An operating section 11d can set plural image processing functions necessary for forming an image. An image output section 12 forms an image on a recording paper supplied from a paper feed cassette 12a or 12b.

Figure 3:
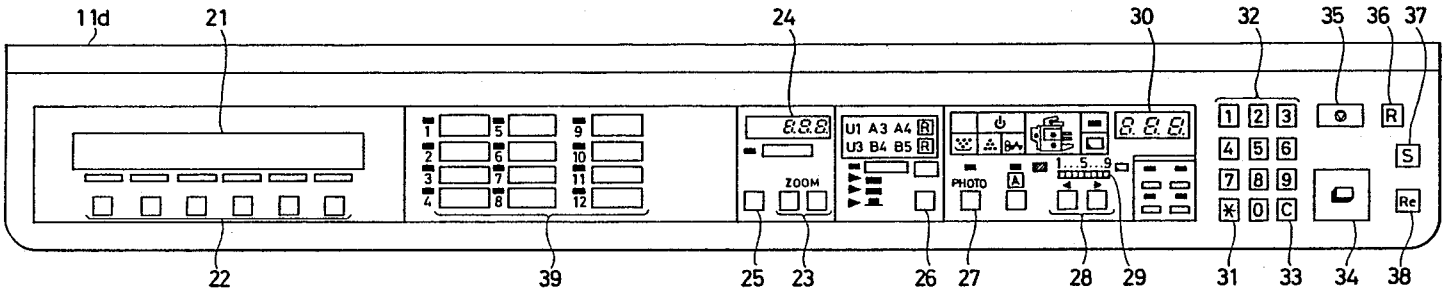
FIG. 3 is an enlarged, plan view showing the operating section shown in FIG. 2.

FIG. 3 is an enlarged, plan view of the operating section 11d shown in FIG. 2. When any one of setting keys 22 is pressed, a corresponding mode is displayed on a liquid crystal display 21. A zoom key 23 sets a magnification ratio of an output image to the original 11c. A magnification ratio display 24 uses a 7 segment display for displaying a magnification ratio set by depressing the zoom key 23. An automatically variable magnification selection key 25 automatically sets a magnification ratio in accordance with the size of a recording paper of the paper feed cassette 12a or 12b. A paper selection key 26 selects either the paper feed cassette 12a or 12b which is loaded in the image output section 12. A photograph mode selection key 27, when it is depressed, effects a half-tone process such as a dither process for a photograph image read by the image input section 11. A density selection key 28 sets a desired image density of the read-out image. A density display 29 illuminates its light emitting diode when the density selection key 28 is depressed. A numeral display 30 displays numerals inputted using an enter key 31 and ten keys 32. A clear key 33 clears inputted numerals. A copy key 34 is used to start forming an image. The copy key 34 functions similarly to a store key described later. A stop key 35 is depressed to interrupt a copy operation. A reset key 36, when it is depressed, causes a standard mode to be restored instead of a special operating mode set by means of the described controls. A store key 37 is used to sequentially write a currently set operating mode in the operating mode memory means 5 each time it is depressed. A recall key 38 is used to cyclically read operating modes stored in the operating mode memory means 5, starting from the last stored operating mode, each time it is depressed. Each preset key 39 corresponding to one operating mode is used for reading an operating mode stored in a memory area corresponding to the depressed preset key.

Next, the operation of storing and reading an operating mode according to the present invention will be described with reference to FIG. 4.

Figure 4:
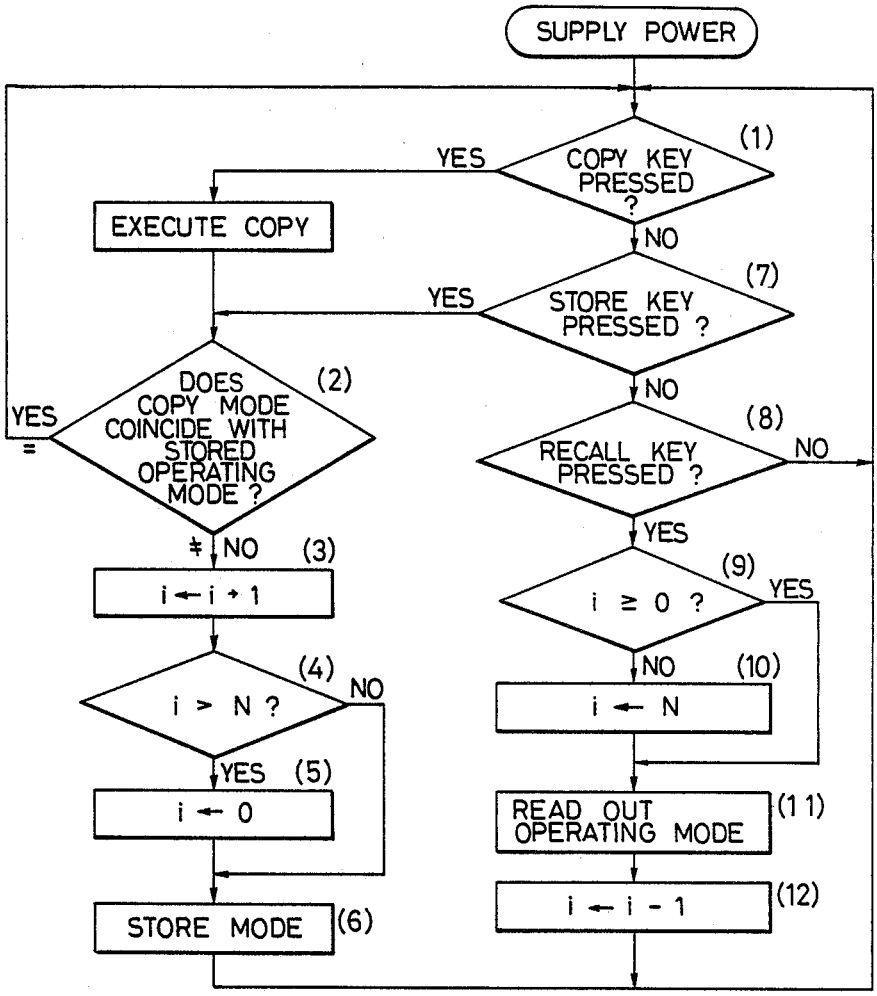
FIG. 4 is a flow chart showing an example of the operation of storing and reading an operating mode according to the present invention.

FIG. 4 is a flow chart for explaining an operation example of storing and reading an operating mode according to the present invention. Reference numerals (1) to (12) represent process steps. A character N in the Figure represents the maximum number of operating modes storable in the operating mode memory means 5, which number can be determined as desired based on the hardware. Therefore, if $N \geqq 2$, a one-to-one correspondence is not retained between the recall key and the memory area. i represents the count of an unrepresented counter, the count value being O to N−i and being used as address information on memory areas $M_O$ to $M_{N-1}$ of the operating mode memory means 5 storing operating modes. One memory area M can store one operating mode having plural image forming functions (density setting, paper selection, inputted numerals and so on) necessary for forming an image.

The flow starts when the power is turned on. First, depression of the copy key 34 is checked for at step (1). If YES, a copy operation is carried out, and it is checked at step (2) if the current copy mode coincides with one of the stored operating modes in the operating mode memory means 5, by reading the contents of the memory areas $M_O$ to $M_{N-1}$ and comparing the readout content with the current copy mode. If YES, the flow returns to step (1). If NO, the count i is incremented by 1 at step (3) to check at step (4) if the count i exceeded the maximum number N. If NO, the flow jumps to step (6). If YES, the count i is cleared to "0" and thereafter, the currently set operating mode is stored at step (6) in the operating mode memory means 5 at the memory address Mi indicated by the count i to return to step (1).

If NO at step (1), depression of the store key 37 is checked for at step (7). If YES at step (7), the flow goes to step (2). If NO, depression of the recall key 38 is checked for at step (8) to effect reading the operating modes stored in the operating mode memory means 5. If NO, the flow returns to step (1). If YES, it is checked at step (9) if the count i is "0" or larger. If YES, the flow jumps to step (11) and following steps. If NO, the maximum number N is inputted as the count i at step (10) and thereafter, the operating mode stored in the operating mode memory means 5 at the memory area Mi indicated by the count i is read at step (11), and the count i is decremented by 1 to return to step (1).

As seen from the foregoing description, each time the copy key 34 or the store key 37 is depressed, only a currently set operating mode different from those already stored can be sequentially stored. On the other hand, each time the recall key 38 is depressed, the operating modes can be cyclically read starting from the last-stored one.

If the recall key is depressed while no operating modes are stored, the operating mode does not change. Further, a standard operating mode may be stored previously. The read-out operating mode may be changed upon actuation of each key on the operating section.

Another preferred embodiment will be described.

Figure 5:
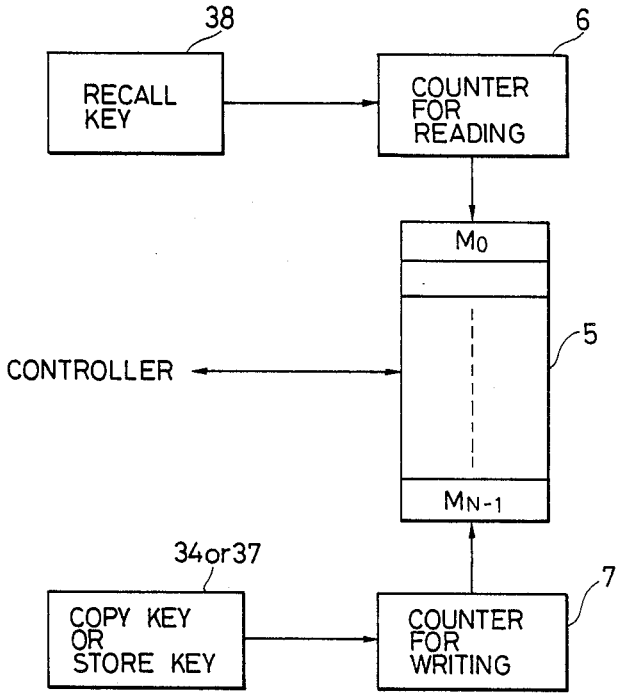
FIG. 5 is a detailed diagram showing the operating mode memory means.

FIG. 5 is a detailed diagram showing the operating mode memory means. A counter 6 is decremented by 1 upon depression of the recall key 38. The counter 6 indicates from which memory area Mj of the operating mode memory means 5 the data is to be read. A counter 7 is incremented by 1 upon depression of the copy key 34 or the store key 37. The counter 7 indicates in which memory area Mj of the operating mode memory means 5 the data is to be written.

Figure 6:
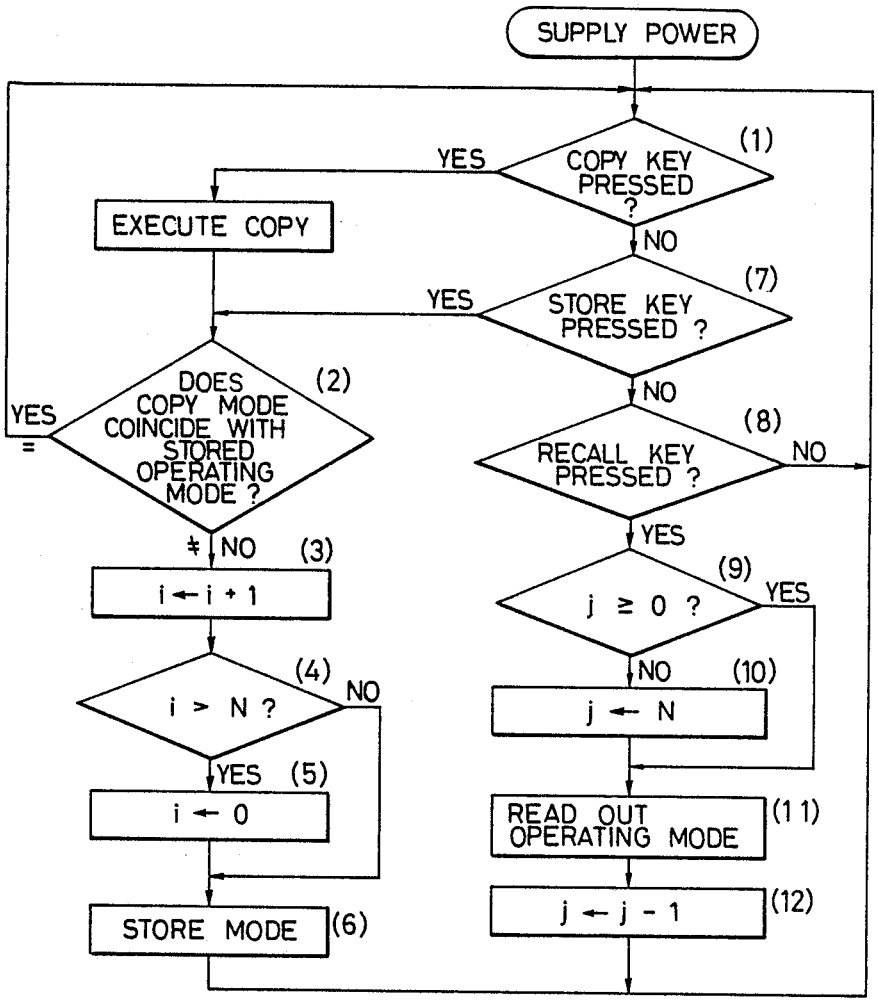
FIG. 6 is a flow chart showing an example of the operation of storing and reading an operating mode.

An operation example of storing and reading an operating mode according to this embodiment is shown in the flow chart of FIG. 6. This flow chart is idential to that of FIG. 4 except that the count i at steps 9, 10 and 12 is changed to j.

Another embodiment will be described.

Figure 7:
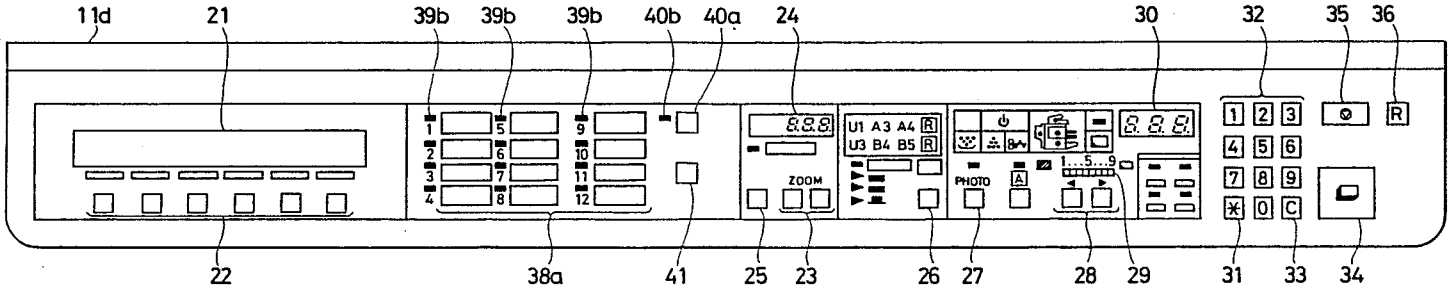
FIG. 7 is an enlarged, plan view of the operating section shown in FIG. 2.

FIG. 7 is an enlarged, plan view of the operating section 11d shown in FIG. 2, wherein elements identical to those in FIG. 3 are designated using the same reference numerals.

Preset keys 39a (e.g., 12 keys) selectively turn on, when they are depressed, display elements 39b (12 elements). The preset key 39a enables one to store and read an operating mode. While a mode for storing an operating mode is set by keys 22 and when the preset key 39a is depressed, a currently setting operating mode is stored in the memory area corresponding to the depressed preset key. In a mode other than the above, an operating mode stored in the memory area corresponding to the depressed preset key 39 is read and set. A program key 40*a* corresponds to the store key 37 of FIG. 3. Upon depression of the program key 40*a*, a display 40*b* is turned on and the currently set operating mode is stored in the memory area of the operating mode memory means 5. A read key 40 corresponds to the recall key 38 of FIG. 3. Each time the read key 40 is depressed, a command issues to cause the operating modes stored in the operating mode memory means 5 to be sequentially read.

Next, the operation of storing an operating mode according to this embodiment will be described with reference to FIG. 8.

Figure 8:
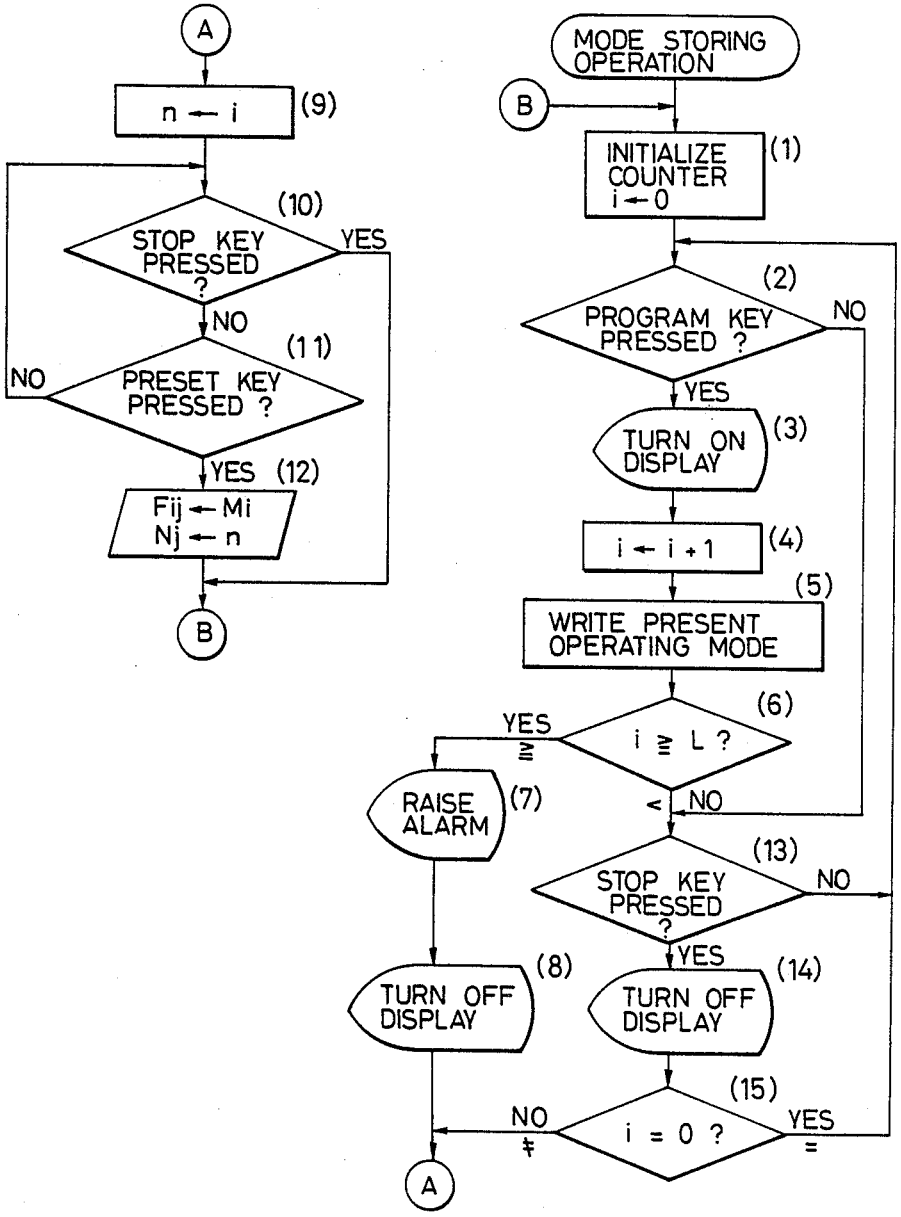
FIG. 8 is a flow chart showing an example of the operation of storing an operating mode according to the present invention.

FIG. 8 is a flow chart for explaining the operation of storing an operating mode according to this embodiment. References (1) to (15) represent flow steps. j in the Figure represents the key number of each preset key 39*a*, the number being 1 to 12. The number of image processing functions necessary for forming an image and stored in the operating mode memory means 5, is counted by an unrepresented counter whose count i is 1 to L (where L represents the upper limit of the number of operating modes, to be set properly depending on the memory capacity).

First, the count i of the counter is initialized to "0" at step (1). Then, depression of the program key 40*a* is checked for at step (2). If NO, the flow jumps to step (13) and following steps. If YES, the display 40*b* is turned on to inform the operator of the program key depression at step (3). Next, the count i is decremented by 1 at step (4). Then, the controller 1 causes the currently set operation mode to be written in the operating mode memory means 5 at the memory space Mi at step (5). Next, it is checked if the count i is larger than L at step (6). If YES, an alarm is raised, for example, by temporarily flashing the display 40*b* or by producing an alarm voice at step (7) and thereafter, the display 40*b* is turned off at step (8). Next, the number n of image processing functions is inputted as the count i at step (9). Succeedingly, depression of the stop key 35 is checked for at step (10). If YES, the flow returns to step (1). If NO, a depression of preset key 39*a* (j) is checked for at step (11). If NO, the flow returns to step (10). If YES, the number n of image processing functions is stored in the operating mode memory means 5 at the memory area Nj, and the content of the memory space Mi is written in the memory area Fij at step (12) to return to step (1). Thus, when the program key is depressed three times before the stop key is depressed, the contents of $M_1$ to $M_3$ are stored in $F_{1j}$ to $F_{3j}$.

If NO at step (6), depression of the stop key 35 is checked for at step (13). If NO, the flow returns to step (2). If YES, the display 40*b* is turned on at step (14). Next, it is checked at step (15) if the count i is "0" or not. If YES, the flow returns to step (2). If NO, the flow goes to step (9).

Next, the operation of setting an operating mode according to this embodiment will be described with reference to FIG. 9.

Figure 9:
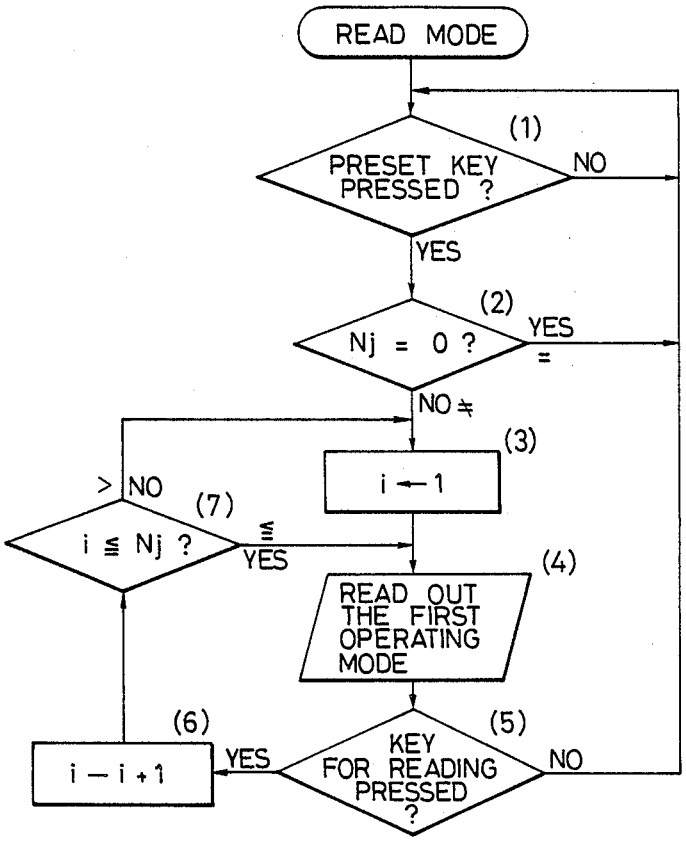
FIG. 9 is a flow chart showing an example of the operation of setting an operating mode according to the present invention.

FIG. 9 is a flow chart for explaining an operation example of setting an operating mode according to this embodiment. References (1) to (7) represent flow steps. It is assumed that the operating modes corresponding to the preset keys 39*a* (12 keys) have already been stored in the operating mode memory means 5.

First, depression of the preset key 39*a* is awaited at step (1). When the preset key 39*a* is depressed, it is checked at step (2) if the number n of image processing functions stored in the memory area Nj is "0" or not. If YES, the count i of the counter is set at "1" at step (3). Succeedingly, the ith operating mode stored in the operating mode memory means 5 is read at step (4) to change the operating mode before the depression of the preset key 39*a*. Next, depression of the read key 41 is checked for at step (5). If NO, the flow returns to step (1). If YES, the count i is incremented by 1 at step (6), and it is checked at step (7) if the count i is smaller than the number n of image processing functions stored in the memory area Nj. If YES, the flow returns to step (4), whereas if NO, the flow returns to step (3).

The present invention is not intended to be limited to the above-described embodiments only, and various alterations are possible within the scope of the invention.

I claim:

1. An image processing apparatus comprising:
mode setting means for setting an image processing mode;
processing means for processing an image based on a processing mode set by said mode setting means;
memory means for storing the processing mode set by said mode setting means in order to enable said processing mode to be repeatedly set; and
control means for causing a plurality of processing modes most lately executed to be registered.

2. An image processing appartus according to claim 1, further comprising reading means for cyclically reading out said registered processing mode in order to set a processing mode.

3. An image processing apparatus according to claim 2, wherein said reading means comprises one key for reading out a registered processing mode.

4. An image processing apparatus according to claim 3, wherein said reading means reads a next processing mode each time said key is depressed.

5. An image processing apparatus according to claim 2, wherein said reading means reads out processing modes in an order starting from the last registered processing mode to the first registered processing mode.

6. An image processing apparatus according to claim 1, further comprising input means for inputting a command for causing said processing means to start operating, wherein said control means causes a processing mode to be registered in response to command of said input means.

7. An image processing apparatus comprising:
mode setting means for setting an image processing mode;
processing means for processing an image based on a processing mode set by said mode setting means;
input means for inputting a command for starting an operation of said image processing means;
memory means for registering the processing mode set by said mode setting means in order to enable said processing mode to be repeatedly set; and
control means responsive to said command from said input means for making said processing mode to be stored in said memory means.

8. An image processing apparatus according to claim 7, wherein said memory means is capable of storing a plurality of modes.

9. An image processing apparatus according to claim 8, wherein, when a new processing mode is to be stored in a state wherein the largest number of processing modes which said memory means is capable of storing are registered, said control means overwrites said new processing mode over one of the registered processing modes chosen from the registered processing modes according to a predetermined order.

10. An image processing apparatus according to claim 9, wherein said control means overwrites said new processing mode in the order starting from the first-stored processing mode to the last-stored one.

11. An image processing apparatus according to claim 7, wherein said memory means is a non-volatile memory medium.

12. An image processing apparatus comprising:

mode setting means for setting an image processing mode;

processing means for processing an image based on a processing mode set by said mode setting means;

memory means for storing the processing mode set by said mode setting means in order to enable said processing mode to be repeatedly set; and control means for making said image processing mode to be stored in said memory means, wherein said control means inhibits storing of a processing mode identical to one already stored in said memory means.

13. An image processing apparatus according to claim 12, wherein said control means causes an operating mode, in which an image processing has been performed, to be stored.

14. An image processing apparatus according to claim 12, wherein said memory means is a non-volatile memory medium.

15. An image processing apparatus according to claim 12, further comprising input means for inputting a command for starting an operation of said image processing means, said control means causing a processing mode set upon input of said command to be registered in said memory means.

16. An image processing apparatus according to claim 12, wherein said control means includes comparing means for comparing a processing mode already registered in said memory means with a processing mode newly set, and wherein, when a processing mode identical to said newly-set processing mode has already been registered in said memory means, said control means inhibits registration of said newly-set processing mode.

17. An image processing apparatus according to claim 16, further comprising input means for inputting a command for causing an image processing means to start operating, wherein said control means causes the processing modes to be compared in response to inputting of said command.

18. An image processing apparatus according to claim 15, wherein said control means causes said processing mode to be registered in said memory means in response to an input of said command.

19. An image processing apparatus comprising:

mode setting means for setting an image processing mode;

processing means for processing an image based on an processing mode set by said mode setting means;

input means for inputting a command for starting an operation of said image processing means;

memory means for storing the processing mode set by said mode setting means in order to enable said processing mode to be repeatedly set;

first memory control means for causing a processing mode set upon inputting of said command to be registered in said memory means; and second memory control means for causing said set processing mode to be registered in said memory means without starting an operation of said processing means.

20. An image processing apparatus according to claim 19, wherein said first memory control means operates in response to inputting of said command.

21. An image processing apparatus according to claim 19, wherein said second memory control means operates in response to an input from a specific register command key different from said input means.

22. An image processing apparatus according to claim 19, wherein said memory means is a non-volatile memory medium.

23. An image processing apparatus according to claim 19, wherein said memory means can store a plurality of processing modes.

24. An image processing apparatus according to claim 19, further comprising reading means for reading out said registered processing mode in order to repeatedly set a processing mode registered in said memory means, wherein a method by which a processing mode registered by said first memory control means is read out from said memory means is different from a method by which a processing mode registered by said second memory control mean is read out from said memory means.

* * * * *

UNITED STATES PATENT AND TRADEMARK OFFICE

CERTIFICATE OF CORRECTION

PATENT NO. : 4,809,041

DATED : February 28, 1989

INVENTOR(S) : MASAHIRO FUNADA

It is certified that error appears in the above-identified patent and that said Letters Patent is hereby corrected as shown below:

Title page:

AT [54] ABSTRACT

Line 9, "operating" should be deleted.

AT [57] ABSTRACT

Line 10, "process" should read --processor--.

COLUMN 1

Line 64, "appartus" should read --apparatus--.

COLUMN 2

Line 36, "and 4b." should read --and displays 4b.--.
Line 65, "one" should read --one,--.

COLUMN 3

Line 45, "last stored" should read --last-stored--.

COLUMN 4

Line 12, "exceeded" should read --exceeds--.
Line 55, "idential" should read --identical--.
Line 68, "setting" should read --set--.

COLUMN 6

Line 31, "appartus" should read --apparatus--.
Line 49, "to command" should read --to said command--.

UNITED STATES PATENT AND TRADEMARK OFFICE

CERTIFICATE OF CORRECTION

PATENT NO. : 4,809,041

DATED : February 28, 1989

INVENTOR(S) : MASAHIRO FUNADA

It is certified that error appears in the above-identified patent and that said Letters Patent is hereby corrected as shown below:

COLUMN 8

Line 12, "an" (second occurrence) should read --a--.
Line 48, "memory control mean" should read --memory control means--.

Signed and Sealed this

Twenty-third Day of January, 1990

*Attest:*

JEFFREY M. SAMUELS

*Attesting Officer*

*Acting Commissioner of Patents and Trademarks*